US006428384B1

(12) United States Patent
Su

(10) Patent No.: US 6,428,384 B1
(45) Date of Patent: Aug. 6, 2002

(54) CARTRIDGE EJECTING CONTROL MECHANISM FOR TOY REVOLVER

(75) Inventor: Susan Su, Taipei Hsien (TW)

(73) Assignee: Ho Feng Industry Co., Ltd., Taipei Hsien (TW)

( * ) Notice: Subject to any disclaimer, the term of this patent is extended or adjusted under 35 U.S.C. 154(b) by 41 days.

(21) Appl. No.: 09/696,230

(22) Filed: Oct. 26, 2000

(51) Int. Cl.[7] ..... A63H 33/30
(52) U.S. Cl. ..... 446/473; 446/475
(58) Field of Search ..... 446/473, 483, 446/475, 491; 42/89, 47, 68

(56) References Cited

U.S. PATENT DOCUMENTS 2,625,927 A * 1/1953 Rosenbloom
4,516,345 A * 5/1985 Flodman ..... 42/46
5,109,621 A * 5/1992 Blaser ..... 42/46
5,256,100 A * 10/1993 Wang ..... 446/473

* cited by examiner

*Primary Examiner*—Derris H. Banks
*Assistant Examiner*—Jamila Williams
(74) *Attorney, Agent, or Firm*—Rabin & Berdo, P.C.

(57) ABSTRACT

A cartridge ejecting control mechanism for toy revolver, comprising of a cartridge inserting rubber seat, a cartridge inserting rubber, a cartridge clasp track, a cartridge clasp, a cartridge track, an ejector, a cartridge track spring and a cartridge track cover, which are sequentially installed in each cartridge hole of a cartridge unit to be loaded into the cylinder of a toy revolver, before a cartridge unit cover is fitted to the rear end. In such a mechanism, each cartridge of the cartridge unit can be loaded with a plurality of shots. When each time the trigger is pressed, gas pushes the cartridge clasp forward to clasp the second shot while the first shot is fired. After the firing process, the resiliency of the cartridge clasp will push the second cartridge to the cartridge inserting rubber; to the effect that only one shot is fired at a time until all shots are fired from the cartridges when reloading is required. Therefore, it significantly reduces the frequency of reloading the shots and effectively adds fun to the game of toy revolver shooting.

2 Claims, 4 Drawing Sheets

CARTRIDGE EJECTING CONTROL MECHANISM FOR TOY REVOLVER

BACKGROUND OF THE INVENTION

This invention relates to a cartridge ejecting control mechanism for a toy revolver, particularly an innovated cartridge ejecting control mechanism that comprises a cartridge inserting rubber seat, a cartridge inserting rubber, a cartridge clasp track, a cartridge clasp, a cartridge track, an ejector, a cartridge track spring, and a cartridge track cover, which are sequentially installed in each cartridge hole of a cartridge unit to be loaded into the cylinder of a toy revolver, before a cartridge unit cover is fitted to the rear end, which will fire only one shot each time the trigger is pressed, thus effectively increasing the number of shots to be fired and adding fun to the shooting game.

The conventional toy revolver involves the loading of BB bullets by inserting a cartridge unit into a revolving cylinder, without the use of a magazine. Since the capacity of the cartridge unit is limited, the number of shots that can be loaded is much less than other models of toy guns, because only six shots can be fired. FIG. 1 shows the cylinder mechanism of the conventional toy revolver, in which, six cartridges A are respectively inserted in the cartridge holes B1 of a revolving cylinder B that is driven by pressing the trigger. FIG. 2 shows the construction of such a cartridge A, which is shaped as a hollow cylinder. At one end is embedded a flexible lining A1 made of flexible material. The bullet C (BB bullet) is loaded to the end of the cartridge A and embedded in the flexible lining A1. After six cartridges A are inserted in the six cartridge holes B1 of the cylinder B, the user's pressing on the trigger will drive the gas inside the revolver to push out the bullet C inside the cartridge A, which is aligned to the trigger position, to the firing chamber before it is fired. Since there are only six cartridges A, a maximum of six shots can be fired. There is no such mechanism inside each cartridge A for effectively clasping or releasing the bullet C. So, even if the flexible lining A1 is made to have a same length as the cartridge A, allowing several bullets C to be loaded simultaneously, all the bullets C loaded in the same one cartridge A will be pushed out simultaneously by the gas. The result is the same; only six shots can be fired. The conventional toy revolver thus needs to be loaded frequently to continue the shooting game. The problem of frequent and sophisticated reloading should be overcome.

In view of the above shortcoming in conventional toy revolvers, the inventor has utilized his many years' experience in the research and development, test production, tests and modifications of all types of toys (especially toy guns), and has finally come up with this invention of "cartridge ejecting control mechanism for toy revolver", enabling simultaneous loading of multiple shots in each cartridge, each shot to be fired by each triggering process, so as to increase the frequency of shooting, reduce the frequency of reloading, and enhance the fun of shooting game.

BRIEF DESCRIPTION OF DRAWINGS

The drawings of preferred embodiments of this invention are described in following details to enable better understanding.

DETAILED DESCRIPTION OF PREFERRED EMBODIMENTS

Figure 1:
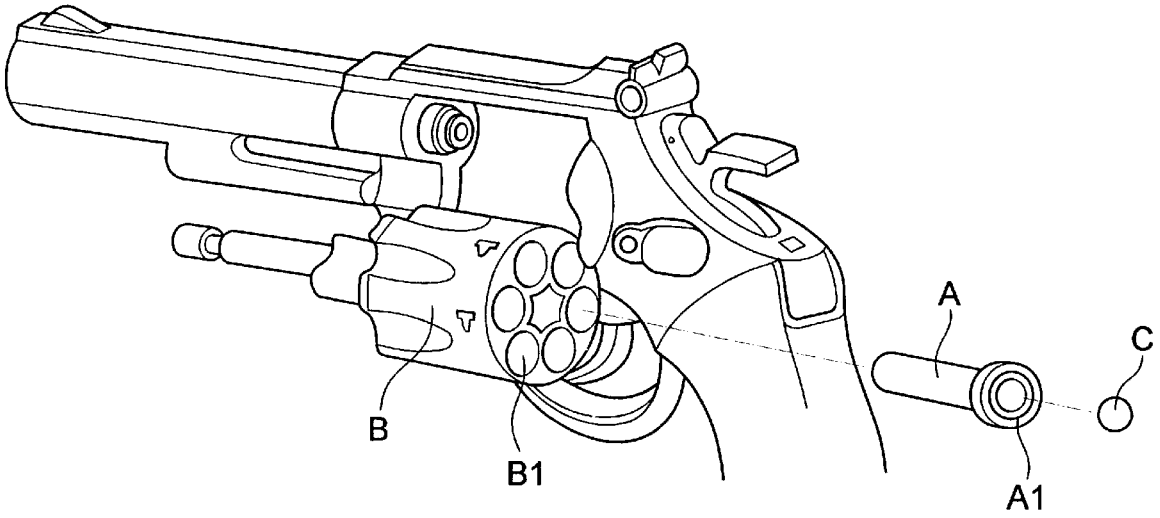
Fig.1 PRIOR ART
FIG. 1 is a perspective view of the prior art of toy revolver.
Figure 2:
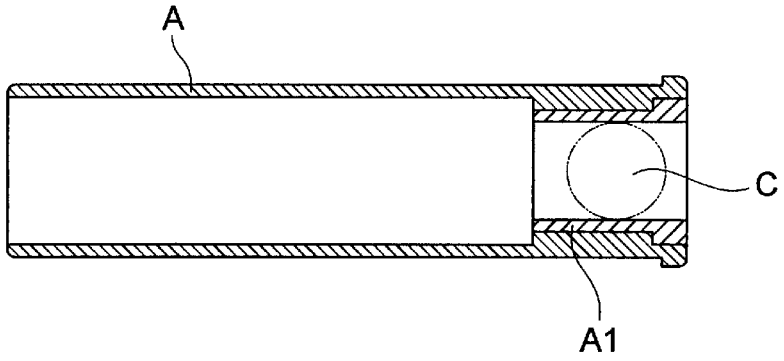
Fig.2 PRIOR ART
FIG. 2 is a section view of the cartridge in the prior art of toy revolver.
Figure 3:
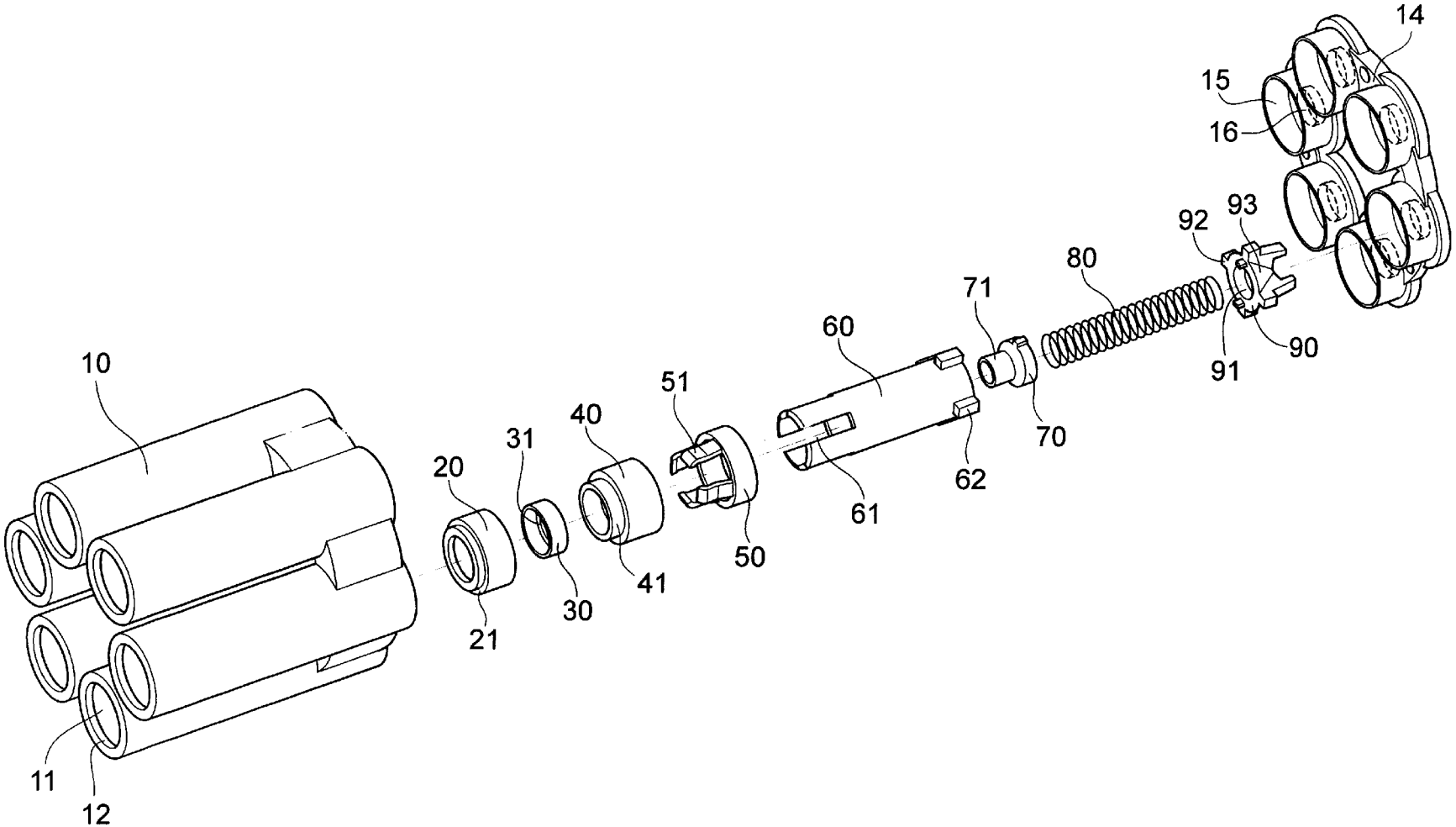
FIG. 3 is an exploded view of this invention.
Figure 4:
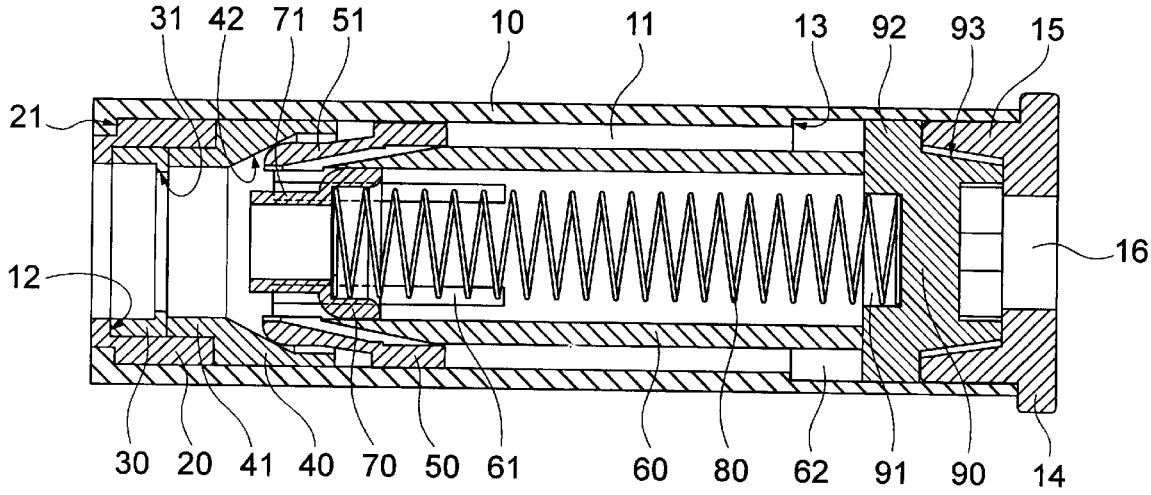
FIG. 4 is a section view of this invention.

As shown in FIGS. 3 and 4, this invention involves a cartridge unit 10 consisting of six cartridges in combined configuration, which is different from the conventional toy revolver (the conventional cartridges are made in separate pieces). Fitted to the cylinder is a cartridge unit cover 14 that is also in combined configuration. Therefore, the cartridge unit 10 is loaded in the cylinder of a revolver in only one process, while the conventional revolver requires six loading processes. This invention is designed in a way that, in respective cartridge hole 11 of the cartridge unit 10 are installed, in sequential order, a cartridge inserting rubber seat 20, a cartridge inserting rubber 30, a cartridge clasp track 40, a cartridge clasp 50, a cartridge track 60, an ejector 70, a cartridge track spring 80 and a cartridge track cover 90, before the cartridge unit cover 14 is covered on them from the rear end.

The cartridge unit 10 is a combined unit of six cartridges, each having an axially through cartridge hole 11. At the front opening of the cartridge hole 11 and stepped inwardly is a front stop rim 12. At the rear end and extended outwardly is the formation of a rear stop rim 13.

The cartridge inserting rubber seat 20 is axially through, with an inwardly stepped rim to form a shoulder 21. It is installed at the front end inside the cartridge hole 11 of the cartridge unit 10. The engagement formed by the shoulder 21 and the front stop rim 12 of the cartridge hole 11 serves to fix its position and prevent it from escaping the front end of the cartridge hole 11.

The cartridge inserting rubber 30, preferably made of flexible material (such as rubber), is a hollow ring. At the rear end of its inside is a protruded ring 31. This rubber 30 is inserted into the cartridge inserting rubber seat 20, its front rim being engaged and fixed to the inside rim of the shoulder 21 of the cartridge inserting rubber seat 20.

The cartridge clasp track 40 is an axially through cylinder. Extending from its front end is a protrusion 41 with a slightly smaller outer diameter. At the middle section of the inside bore is a tapered face 42. The protrusion 41 at its front end is inserted and fixed to the rear end inside the cartridge inserting rubber seat 20.

The cartridge clasp 50, preferably made of flexible plastic material, is a hollow ring. At its front end and equally spaced are several clasp claws 51 that are somewhat inclined toward the axis. The clasp claws 51 are inserted through the rear end of the cartridge clasp track 40, and clasped to the rear of the cartridge clasp track 40 in the cartridge hole 11.

The cartridge track 60 is an elongated hollow cylinder, with an outer diameter to be fitted to the inner diameter of the cartridge clasp 50. At its front end and equally spaced are several slotted grooves 61. On the rim of its rear end and also equally spaced are several jutted pieces 62. It is fixed inside the cartridge hole 11 by slightly penetrating its front end into the inner hole of the cartridge clasp 50 and by engaging the front edge of each jutted piece 62 to the rear stop rim 13 inside the cartridge hole 11, maintaining an appropriate clearance from the cartridge hole 11.

The cartridge ejector 70 has an outer diameter to match the inner diameter of the cartridge track 60. Having a hollow inside, its front end has a slightly retracted protrusion 71, which can be installed inside the cartridge track 60 to slide smoothly back and forth.

The cartridge track spring 80 has an outer diameter to match the inner diameter of at the rear end of the ejector 70. It is inserted and fixed between the ejector 70 and the cartridge track cover 90.

The cartridge track cover 90 has a depressed hole 91 at its front end to accommodate the cartridge track spring 80. There are several jutted pieces 92 that are equally spaced on its outer rim, and a tapered face 93 on the surface between the jutted pieces 92. It is fixed at the rear of the cartridge track 60 in the cartridge hole 11.

The cartridge unit cover 14 has the same size specifications to match those of the cartridge unit 10, as well as six cover rings 15 that can be tightly fitted to each cartridge hole 11. Meanwhile, at the rear face of each ring cover 15 is an air inlet 16 to allow access of gas for the revolver. The cover 14 can be fitted and fixed to the rear end of the cartridge unit 10 by inserting each cover ring 15 into each cartridge hole 11, thereby fixing all components that are accommodated inside the cartridge holes 11.

Figure 5:
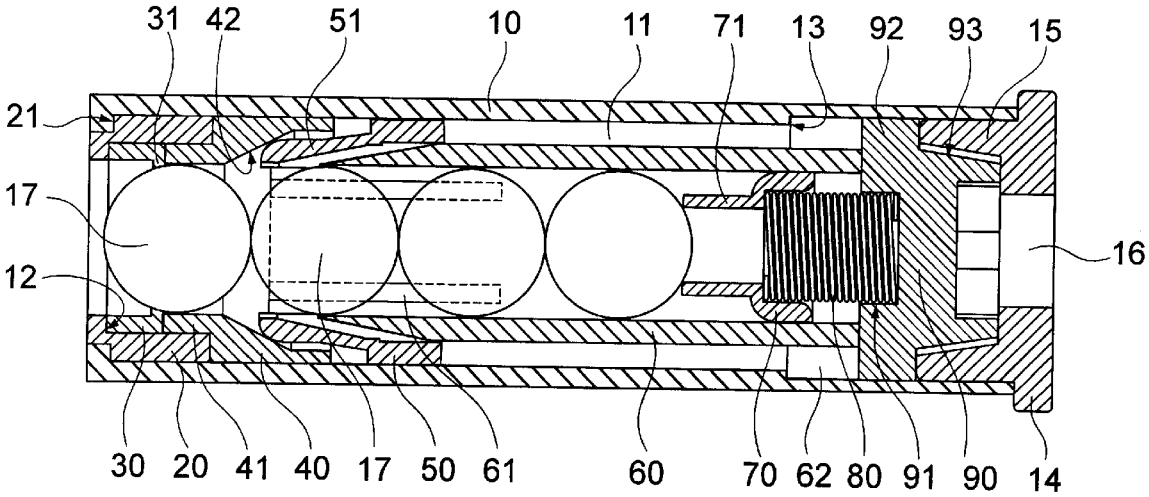
FIG. 5 illustrates how the bullets are loaded in this invention.

The bullet (BB) 17 is loaded in a way shown in FIG. 5. The bullet 17 is inserted in the front end of the cartridge hole 11. When it passes the protruded ring 31 inside the cartridge inserting rubber 30, the bullet 17 will be pushing against and pushed by the ejector 70. On the other hand, due to obstruction by the protruded ring 31, the bullet 17 will not fall out of the cartridge hole 11. Therefore, several bullets 17 (four bullets are used in this preferred embodiment) are inserted in sequential order into the cartridge track 60 in the cartridge hole 11 to complete the loading process. After all cartridge holes 11 in the cartridge unit 10 are all loaded with bullets 17, the whole piece of cartridge unit 10 is then inserted in the cylinder of the revolver. As mentioned above, since the cartridge unit 10 of this invention involves six cartridges combined as one unit, it requires only one loading process to save time and labor (six loading processes are required in conventional toy revolvers).

Figure 6:
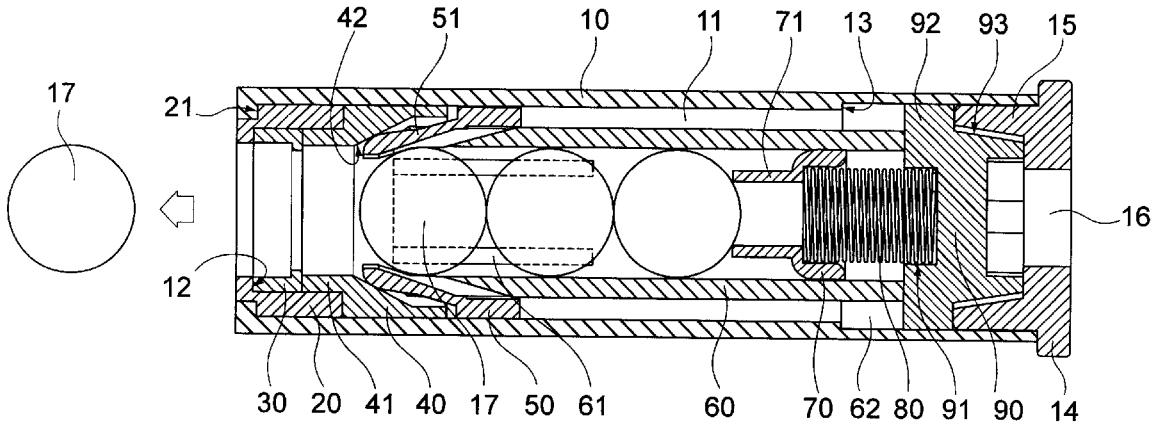
FIG. 6 illustrates how the first bullet is fired.
Figure 7:
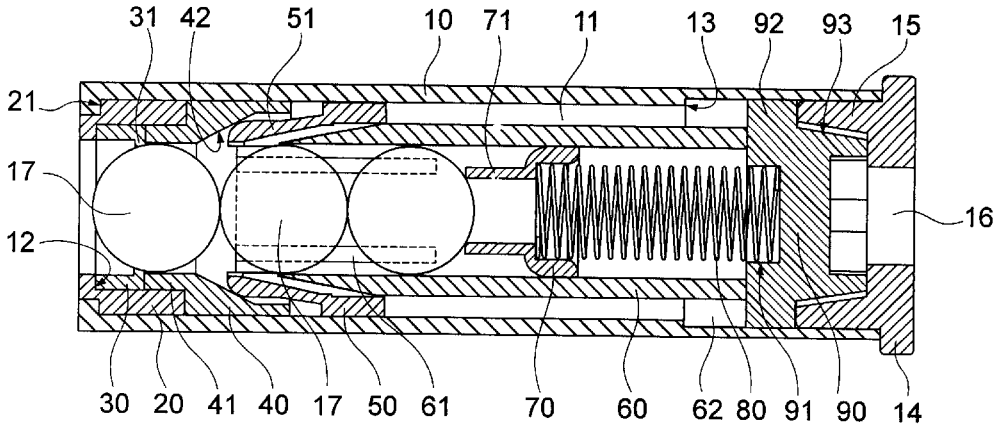
FIG. 7 illustrates how the second [cartridge] bullet is pushed forward by the ejector to anticipate the next firing process after the first bullet is fired and the cartridge clasp is reset to position.

Shooting with this invention of toy revolver is shown in FIG. 6. When the trigger is pressed to drive the gas in the revolver to enter the cartridge holes 11 through the air inlets 16 on the cartridge unit cover 14, the gas will go to the clearances between the jutted pieces 92 from the cartridge unit cover 90, then guided by the tapered face 93, passing through the clearances between the jutted pieces 92 of the cartridge track 60, going forward along the clearances between the cartridge track 60 and the cartridge holes 11, pushing the ejector 50 forward. The clasp claws 51 at the front of the cartridge clasp 50 are contracted by the tapered face 42 in the cartridge clasp track 40, to clasp and fix the second bullet 17, thereby fixing all other bullets following the next and avoiding them from being pushed out of the cartridge holes 11 by the gas. On the other hand, the gas will pass through the clearances between the slotted grooves 61 at the front end of the cartridge track 60 and the clasp claws 51 of the cartridge clasp 50, to forcefully push and fire the first bullet 17, and this bullet 17 only. After the shooting operation, the force of the gas is released. Then the cartridge clasp 50 will stretch and resume its original position, due to the resiliency of the material of the cartridge clasp 50 itself, as well as the recoiling force of the claws 51 and the tapered face 42 inside the cartridge clasp track 40, as shown in FIG. 7. Now the clasp claws 51 will not longer clasp the second bullet 17, so the other bullets 17 following the second are pushed by the ejector 70, pushing the second bullet 17 to the opening of the cartridge hole 11, and stand ready for the next firing process. Therefore, by the mechanism of this invention to clasp and release the bullet 17 for precise control, only one bullet 17 can be fired at a time. As far as this preferred embodiment is concerned, after the cartridges are loaded, as many as 24 shots can be fired successively before reloading is required. It is an advantage over the prior art that requires reloading of bullets after firing only six shots. In addition, it can significantly increase the number of shots for successive shooting, extend the time of play, adding fun to the shooting, and drastically reduce the trouble of reloading.

To conclude, by exquisite structural design, this invention provides an inventive step, improvement and practical amusement by significantly increasing the number of shots for successive firing, extending the time of play, adding fun to the shooting, and reducing the time for reloading. Your favorable consideration will be appreciated.

What is claimed is:

1. A cartridge ejecting control mechanism for a toy revolver, comprising:

a cartridge unit having a plurality of cartridges, each cartridge having a cartridge axial through hole, an inwardly stepped front stop rim at a front opening of the cartridge axial through hole, and an outwardly extending rear stop rim at a rear end of the cartridge axial through hole, each cartridge further having:

a cartridge inserting rubber seat having an axial through hole, and an inwardly stepped rim that forms a shoulder, said cartridge inserting rubber seat being installed at a front end of, and inside the cartridge axial through hole, with the shoulder engaging the front stop rim to fix said cartridge inserting rubber seat in position;

a cartridge inserting rubber formed as a hollow ring, and having an internal protruded ring at a rear end thereof, said cartridge inserting rubber being inserted into said cartridge inserting rubber seat, and having a front rim that is engaged to an inside of the shoulder;

a cartridge clasp track including a cylinder having an axial through hole, and having a protrusion that extends from a front end of the cylinder, the protrusion being inserted within and fixed to a rear end of said cartridge inserting rubber seat, the protrusion having a diameter that is smaller than a diameter of the cylinder, said cartridge clasp track further having an internal middle section having a tapered surface;

a cartridge clasp having a hollow ring, and a plurality of equally spaced clasp claws disposed at a front end of the hollow ring, said clasp claws being inclined toward an axis of said cartridge clasp, being inserted through a rear end of said cartridge clasp track, and abutting against the tapered surface of said cartridge clasp track;

a cartridge track having an elongated hollow cylinder, the elongated hollow cylinder having an outer diameter that allows a front end of the elongated hollow cylinder to be fit within said cartridge clasp, the elongated hollow cylinder having a plurality of equally spaced slotted grooves at the front end thereof, and having a plurality of equally spaced jutted pieces on a rim of a rear end thereof, a front edge of each jutted piece engaging the rear stop rim inside the cartridge through hole to maintain a clearance and to help fix said cartridge track within the cartridge axial through hole;

a cartridge ejector installed inside said cartridge track and being freely slidable therein, and having a hollow interior, and a protrusion at a front end thereof;

a cartridge track cover having a depressed hole at a front end thereof, and having a plurality of equally spaced jutted pieces on an outer rim thereof, and a tapered surface between adjacent ones of the jutted pieces, said cartridge track cover being fixed at a rear of said cartridge track in the cartridge axial through hole; and a cartridge track spring having one end accommodated in the depressed hole of said cartridge track cover, and having another end disposed within the hollow interior of said cartridge ejector; and a cartridge cover unit having a configuration and size to match said cartridge unit, said cartridge cover unit having a plurality of cover rings, each being tightly fitted to a respective cartridge axial through hole, each cover ring having a rear face that has an air inlet to allow access of gas for the revolver, said cartridge cover unit being fitted and fixed to a rear end of said cartridge unit by inserting each respective cover ring into each respective cartridge axial through hole, so that said cartridge cover unit is fixed to the rear end of said cartridge unit, thereby retaining all components of the respective cartridges inside the respective cartridge axial through holes.

2. The cartridge ejecting control mechanism recited in claim 1, wherein said cartridge unit has six cartridges.

* * * * *